US009779890B2

(12) United States Patent
Parro et al.

(10) Patent No.: US 9,779,890 B2
(45) Date of Patent: Oct. 3, 2017

(54) TERMINAL SHIELD WITH INTEGRATED CURRENT TRANSFORMER

(71) Applicant: SCHNEIDER ELECTRIC USA, INC., Schaumburg, IL (US)

(72) Inventors: Jenaro Parro, Montreal (CA); Jorge Koehrmann, Monterrey (MX); Enrique Parra, Monterrey (MX)

(73) Assignee: SCHNEIDER ELECTRIC USA, INC., Andover, MA (US)

( * ) Notice: Subject to any disclaimer, the term of this patent is extended or adjusted under 35 U.S.C. 154(b) by 0 days.

(21) Appl. No.: 14/900,690

(22) PCT Filed: Jun. 28, 2013

(86) PCT No.: PCT/US2013/048527
§ 371 (c)(1),
(2) Date: Dec. 22, 2015

(87) PCT Pub. No.: WO2014/209350
PCT Pub. Date: Dec. 31, 2014

(65) Prior Publication Data

US 2016/0148761 A1 May 26, 2016

(51) Int. Cl.

| | |
|---|---|
| ***H01H 9/02*** | (2006.01) |
| ***H01H 13/04*** | (2006.01) |
| ***H01H 19/04*** | (2006.01) |
| ***H01H 21/04*** | (2006.01) |
| ***H01F 38/20*** | (2006.01) |

(Continued)

(52) U.S. Cl.
CPC ..... *H01H 9/0264* (2013.01); *H01F 38/20* (2013.01); *H01F 38/28* (2013.01); *H01H 71/125* (2013.01)

(58) Field of Classification Search
CPC .... H01H 9/0264; H01H 71/125; H01F 38/20; H01F 38/28
USPC .... 200/304, 293, 296, 303, 305, 333; 361/1, 361/93.1, 93.5, 93.6, 600, 605, 615, 616
See application file for complete search history.

(56) References Cited

U.S. PATENT DOCUMENTS 4,884,048 A 11/1989 Castonguay et al.
4,977,513 A 12/1990 LaPalme
(Continued)

OTHER PUBLICATIONS

International Search Report and Written Opinion for PCT/US13/48527, mailed Nov. 22, 2013, 10pp.

*Primary Examiner* — Anthony R. Jimenez
(74) *Attorney, Agent, or Firm* — Locke Lord LLP

(57) ABSTRACT

A terminal shield for a circuit breaker, formed of an electrically insulating material, protects an operator from inadvertently touching the load terminal that would otherwise be exposed on the bottom side of the circuit breaker: In accordance with an example embodiment of the invention, the terminal shield is integrated with a toroidally shaped current transformer sensor, to enable measuring the current in a load wire that has been inserted through an aperture in the terminal shield. Preferably there is an access hole in the front portion of the terminal shield, which allows the operator to insert a tool through the front face of the circuit breaker, to tighten the load terminal onto the load wire. The terminal shield with the integrated current transformer sensor enables standardization of load current sensing capability for circuit breakers and further enables ease of installation without clutter in the confined regions of the load center.

11 Claims, 4 Drawing Sheets

(51) Int. Cl.
*H01F 38/28* (2006.01)
*H01H 71/12* (2006.01)

(56) References Cited

U.S. PATENT DOCUMENTS

| | | | | |
|---|---|---|---|---|
| 5,321,378 | A | 6/1994 | Ferullo et al. | |
| 5,539,168 | A | 7/1996 | Linzenich | |
| 6,198,063 | B1 | 3/2001 | Kramer | |
| 6,307,456 | B1 | 10/2001 | Caggiano et al. | |
| 7,170,020 | B2 | 1/2007 | Kawata et al. | |
| 2005/0275493 | A1 | 12/2005 | Yamazaki et al. | |
| 2008/0079437 | A1* | 4/2008 | Robarge ..... | G01R 15/146 324/522 |
| 2013/0107412 | A1 | 5/2013 | Schalk et al. | |
| 2013/0108027 | A1 | 5/2013 | Kioski et al. | |

* cited by examiner

TERMINAL SHIELD WITH INTEGRATED CURRENT TRANSFORMER

FIELD OF THE INVENTION

The invention is generally directed to an electrically insulated terminal shield for a circuit breaker, which is integrated with a current transformer sensor.

BACKGROUND OF THE INVENTION

Electric circuit breakers are commonly used to protect load or branch circuits in residential and commercial buildings against electrical overload and fault conditions. Example circuit breakers comprise a pair of separable contacts, a spring-operated mechanism for causing separation of the contacts, and a tripping mechanism that automatically releases the operating mechanism to break the connection between the contacts upon the occurrence of an electrical overload or fault condition.

Circuit breakers may be constructed with terminals to form an electrical connection with a load wire. Although the terminals may be mounted slightly below the surface of the circuit breaker's casing, it is possible that an operator could be severely burned or shocked if the operator accidentally touched the terminals while installing the circuit breaker. Further, adjacent circuit breakers could be short circuited if they were accidentally joined by a conducting material across the respective terminals. The terminals may also be subject to damage during the installation of other components near the circuit breaker.

Electrically insulated terminal shields have been used on circuit breakers, to cover the load terminal and protect an operator from inadvertently touching the terminals of the circuit breaker. When it has been desired to measure the load current passed by the circuit breaker, it has been the general practice to hang a current transformer sensor loosely somewhere along the load wire. Current transformer sensors are generally toroidally shaped coils that couple the magnetic field produced by the current conducted in the load wire. There have been efforts in the past to fasten the current transformer sensor to a chassis or to the wall of an electrical cabinet, but past mounting mechanisms required tools and special mounting lugs for installation and typically could only be installed at the time of the original assembly of the electrical components in the chassis or cabinet.

SUMMARY OF THE INVENTION

An example embodiment of the invention is an electrically insulated terminal shield for a circuit breaker, which is integrated with a toroidally shaped current transformer sensor. The terminal shield protects an operator from inadvertently touching the load terminal that would otherwise be exposed on the bottom side of the circuit breaker. The toroidally shaped current transformer sensor enables measuring the current in a load wire that has been inserted through an aperture in the terminal shield.

The terminal shield includes a front portion that fits on the front face of the circuit breaker and a bottom portion that fits on the bottom side of the circuit breaker, when the terminal shield is in a closed position on the circuit breaker. The terminal shield has the aperture in the bottom portion through which the load wire is inserted. The toroidal transformer is mounted on the bottom portion of the terminal shield, with the hole of the toroidal transformer preferably aligned with the aperture in the terminal shield. When the terminal shield is in the closed position on the circuit breaker, the aperture of the terminal shield and the hole of the toroidal transformer are preferably aligned with the load terminal of the circuit breaker.

When the load wire is inserted through the aperture of the terminal shield, it passes through the hole of the toroidal transformer and is inserted into the load terminal. Preferably there is an access hole in the front portion of the terminal shield, allows the operator to insert a tool through the front face of the circuit breaker, to tighten the load terminal onto the load wire.

Sensor wires from the current transformer sensor, may pass to the outside of the terminal shield, along the inside surface of the terminal shield, to conduct sensing signals to a measurement device, other equipment, or a network, such as a smart grid network.

In one example embodiment of the invention, the toroidally shaped current transformer sensor is mounted on the inside of the bottom portion of the terminal shield, and fits within the cavity where the load terminal is located, when the terminal shield is in the closed position on the circuit breaker. In another example embodiment of the invention, the toroidally shaped current transformer sensor is mounted on the outside of the bottom portion of the terminal shield. In still another example embodiment of the invention, the toroidally shaped current transformer sensor is encapsulated within the bottom portion of the terminal shield.

The terminal shield with the integrated current transformer sensor enables standardization of load current sensing capability for circuit breakers and further enables ease of installation without clutter in the confined regions of the load center.

BRIEF DESCRIPTION OF THE DRAWINGS

Example embodiments of the invention are depicted in the accompanying drawings that are briefly described as follows.

DETAILED DESCRIPTION OF THE EXAMPLE EMBODIMENTS

Figure 1:
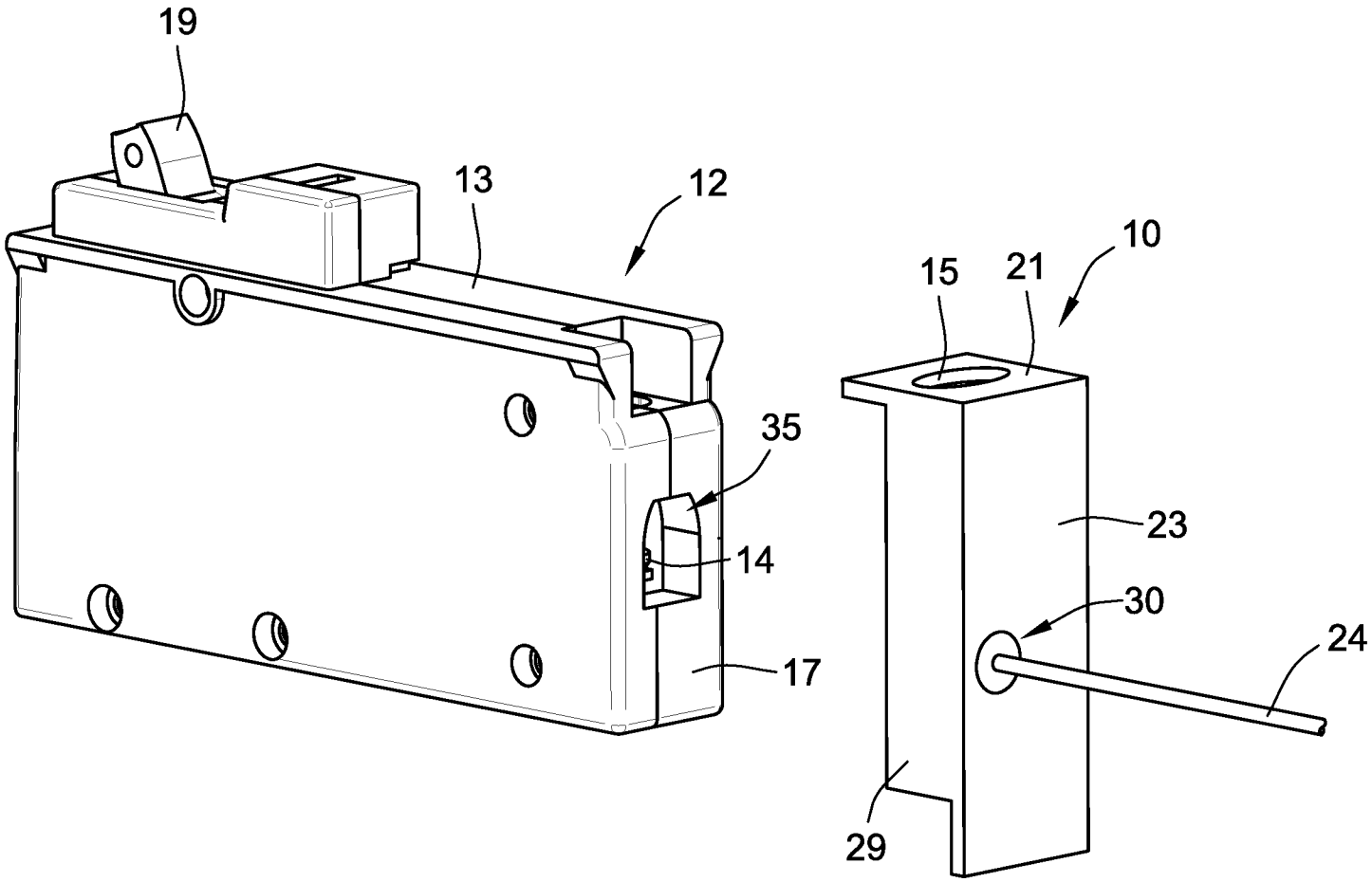
FIG. 1 is a perspective view of the an example embodiment of the invention, illustrating a single pole circuit breaker and an electrically insulated terminal shield for the circuit breaker, which is integrated with a toroidally shaped current transformer sensor.
Figure 2B:
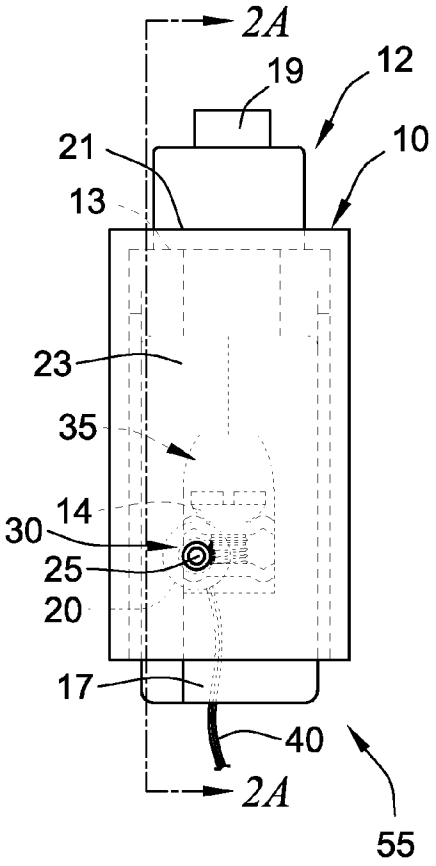
FIG. 2B is a bottom view of the circuit breaker and terminal shield in the closed position, showing the load terminal and the current transformer sensor located within the cavity of the circuit breaker, depicted with hidden lines.
Figure 2A:
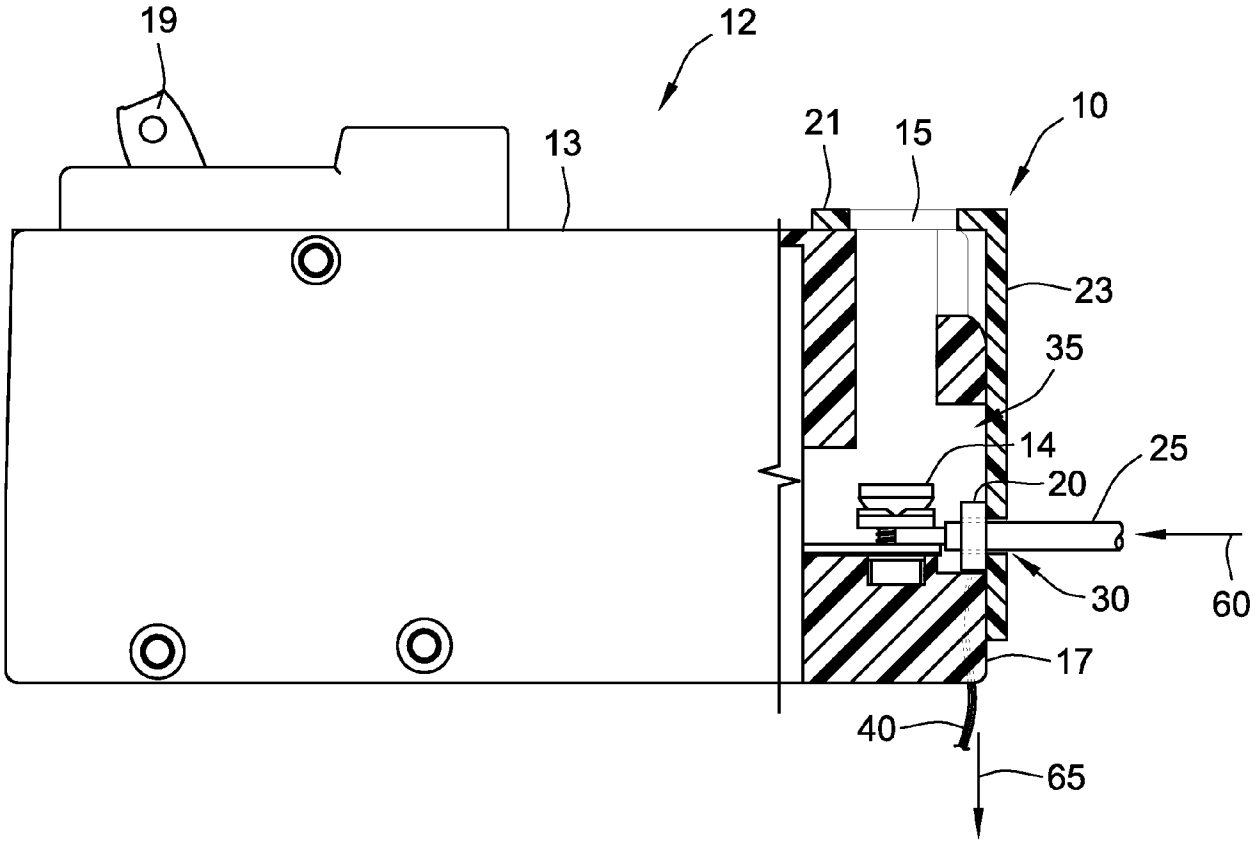
FIG. 2A is a side cross sectional view along the section line 2A-2A' of FIG. 2B, showing the body of the circuit breaker and the terminal shield in cross section, with the terminal shield in the closed position. The load terminal and the current transformer sensor are shown located within the cavity of the circuit breaker and the current transformer sensor is shown mounted on the bottom portion of the terminal shield. The load wire is shown inserted through the aperture of the terminal shield and through the hole in the toroidally shaped current transformer sensor, and into electrical contact with the load terminal, in accordance with an example embodiment of the invention.

FIG. 1 is a perspective view of the an example embodiment of the invention, illustrating a single pole circuit breaker 12 and an electrically insulated terminal shield 10 for the circuit breaker 12, which is integrated with a toroidally shaped current transformer sensor 20 shown in FIG. 2A. The switch handle 19 is shown on the front face 13 of the circuit breaker 12, to enable manually connecting or disconnecting the power supply line from the load terminal 14 located within the cavity 35 on the bottom side 17 of the circuit breaker 12. The terminal shield 10 is depicted in the figure as separated from the circuit breaker so as to show the bottom side 17, the load terminal 14, and the cavity 35 of the circuit breaker 12. The terminal shield 10 comprises a shield structure including a front portion 21 that fits on the front face 13 of the circuit breaker 12 and a bottom portion 23 that fits on the bottom side 17 of the circuit breaker 10, when the terminal shield 10 is in a closed position on the circuit breaker 12, as shown in FIG. 2A. The load wire 25 is shown inserted through the aperture 30 of the terminal shield for electrical connection with the load terminal 14. Preferably there is an access hole 15 in the front portion 21 of the terminal shield 10, which allows the operator to insert a tool through the front face 13 of the circuit breaker 12, to tighten an electrical connection of the load terminal 14 to the load wire 25. The components of the circuit breaker 12 may be housed within a casing assembled from multiple pieces. The circuit breaker 12 has a front face 13 that must be accessible for installation and, subsequently, for operation of the switch handle 19.

FIG. 2A is a side cross sectional view along the section line 2A-2A' of FIG. 2B, showing the body of the circuit breaker 12 and the terminal shield 10 in cross section, with the terminal shield 10 in the closed position. The load terminal 10 and the current transformer sensor 20 are shown located within the cavity 35 of the circuit breaker 12 and the toroidally shaped current transformer sensor 20 is shown mounted on the bottom portion 23 of the terminal shield 10. The load wire 25 is shown inserted through the aperture 30 of the terminal shield 10 and through the hole 22 shown in FIG. 2C, in the toroidally shaped current transformer sensor 20, and into electrical contact with the load terminal 14, in accordance with an example embodiment of the invention.

The load terminal 14 is mounted in the cavity 35 on an interior face to provide the circuit breaker 12 with electrical connection to the external load wire 25. The load terminal 14 includes a machine screw carried by a lug body having suitable threaded surfaces to engage the screw. The lug body has an aperture which, together with the other portions of the load terminal 14, provide for the connection of load wire 25 to the circuit breaker 12 by pinching the load wire between the screw and the bottom of the lug body. The top area of the cavity 35 is open and exposed from the front face 13 of the circuit breaker to provide access to the screw of the load terminal 14 for installation or subsequent maintenance.

The terminal shield 10 for the circuit breaker 12, is formed of an electrically insulating material, to protect an operator from inadvertently touching the load terminal 14 that would otherwise be exposed on the bottom side 17 of the circuit breaker 12.

In accordance with an example embodiment of the invention, the terminal shield 10 is integrated with the toroidally shaped current transformer sensor 20, to enable measuring the current 60 in the load wire 25 that has been inserted through the aperture 30 in the terminal shield 10.

The terminal shield 10 includes a shield structure comprising the front portion 21 that fits on the front face 13 of the circuit breaker 12 and the bottom portion 23 that fits on the bottom side 17 of the circuit breaker 10, when the terminal shield 10 is in the closed position, shown in FIG. 2A, on the circuit breaker 12.

Figure 2D:
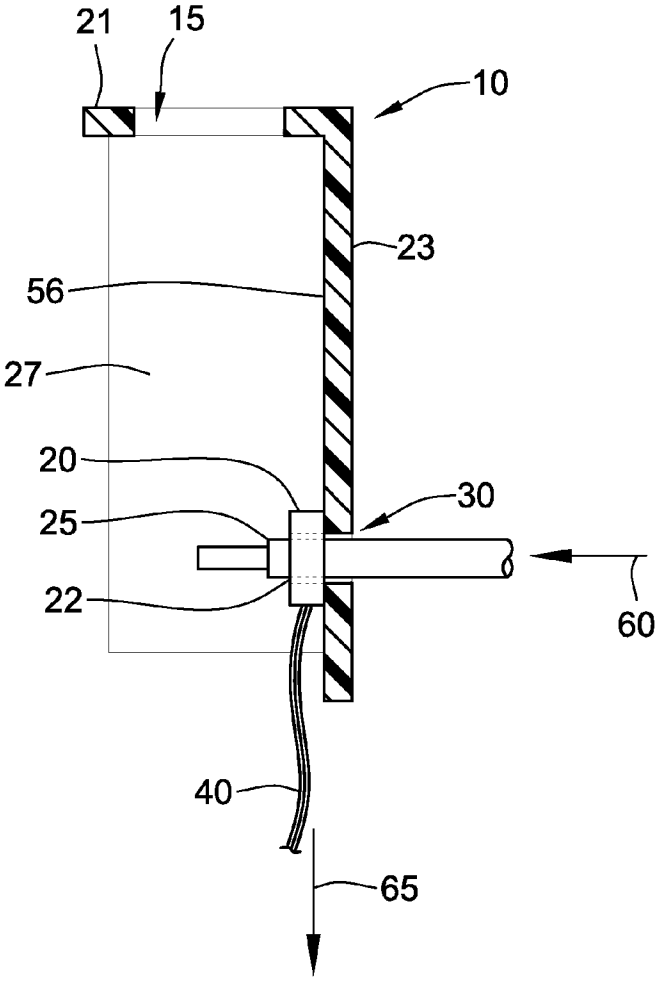
FIG. 2D is a side cross sectional view along the section line 2D-2D' of FIG. 2C, showing the current transformer sensor mounted on the bottom portion of the terminal shield. The load wire is shown inserted through the aperture of the terminal shield and through the hole in the toroidally shaped current transformer sensor, in accordance with an example embodiment of the invention.

The terminal shield 10 has the aperture 30 in the bottom portion 23 through which the load wire 25 may be inserted. The toroidal current transformer sensor 20 is mounted on the inside surface 56 of the bottom portion 23 of the terminal shield 10, as shown in FIG. 2D, with the hole 22 of the toroidal transformer 20 preferably aligned with the aperture 30 in the terminal shield 10. The mounting of the toroidal transformer 20 to the terminal shield 10 may be by means of an adhesive fastening the toroidal transformer 20 to the inside surface 56 of the terminal shield 10, as shown in FIG. 2D. Alternately, the toroidal transformer 20 may be integrally molded into the body of the terminal shield 10, for example, by using a thermoplastic injection molding encapsulation process.

When the terminal shield 10 is in the closed position on the circuit breaker 12, the aperture 30 of the terminal shield 10 and the hole 22 of the toroidal transformer 20 are preferably aligned with the load terminal 14 of the circuit breaker 12.

The toroidally shaped current transformer sensor 20 mounted on the bottom portion 23 of the terminal shield 10, fits within the cavity 35 where the load terminal 14 is located, when the terminal shield 10 is in the closed position on the circuit breaker 12.

When the load wire 25 is inserted through the aperture 30 of the terminal shield 10, it passes through the hole 22 of the toroidal transformer 20 and is inserted into the load terminal 14.

Preferably there is an access hole 15 in the front portion 21 of the terminal shield 10, which allows the operator to insert a tool through the front face 13 of the circuit breaker 12, to tighten the load terminal 14 onto the load wire 25.

Sensor wires 40 from the current transformer sensor 20, may pass to the outside 55 of the terminal shield 10 and circuit breaker 12, along the inside surface 56 of the terminal shield 10, to conduct sensing signal 65 to a measurement device, other equipment, or a network, such as a smart grid network. The sensing signal 65 conducted by the sensor wires 40 may be sent to a web-enabled remote terminal unit device for utilities metering of electricity consumption by the load circuits connected to the load wire 25.

In an alternate example embodiment of the invention, a wireless transmitter may be mounted on the terminal shield 10, and its input connected to the sensor wires 40, for wireless transmission of the sensing signal 65 from the circuit breaker 12 to a remote wireless receiver. Example wireless transmitters that may be mounted on the terminal shield 10, include a Bluetooth™ transceiver circuit and an IEEE 802.11 wireless local area network (WLAN) transceiver circuit.

The terminal shield 10 with the integrated current transformer sensor 20 may be mounted on and affixed to the circuit breaker 12 during a stage of the manufacturing process for the circuit breaker 12. Alternately, the terminal shield 10 with the integrated current transformer sensor 20 may be mounted on and affixed to the circuit breaker 12 in the field, for example, at the time of installation of the circuit breaker 12 in a panelboard. The terminal shield 10 with the integrated current transformer sensor 20 may be mounted on and affixed to the circuit breaker 12 by means of snap fit fasteners, an adhesive bond, heat staking of plastic studs, ultrasonic plastic welding, or fasteners such as pins, rivets, or screws.

The terminal shield 10 with the integrated current transformer sensor 20 enables standardization of load current sensing capability for circuit breakers and further enables ease of installation without clutter in the confined regions of the load center.

FIG. 2B is a bottom view of the circuit breaker 12 and terminal shield 10 in the closed position, showing the load terminal 14 and the current transformer sensor 20 located within the cavity 35 of the circuit breaker 12, depicted with hidden lines. Sensor wires 40 from the current transformer sensor 20, are shown passing to the outside 55 of the terminal shield 10 and circuit breaker 12, to conduct sensing signal 65 to a measurement device. A circuit breaker 12 equipped with the current transformer sensor 20 integrated with the terminal shield 10 allows a close-fit between a plurality of such circuit breakers within a common enclosure, such as a panelboard.

Figure 2C:
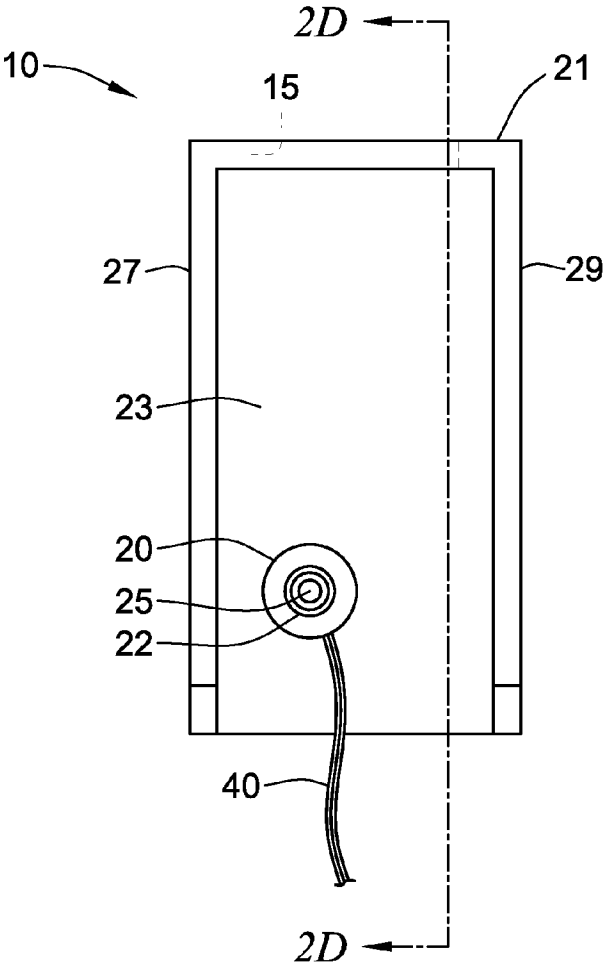
FIG. 2C is a top view of the terminal shield, showing the current transformer sensor mounted on the bottom portion of the terminal shield, in accordance with an example embodiment of the invention.

FIG. 2C is a top view of the terminal shield 10, showing the current transformer sensor 20 mounted on the bottom portion 23 of the terminal shield 10, in accordance with an example embodiment of the invention. The sides 27 and 29 of the terminal shield 10 are shown. The sides 27 and 29 are optional and may assist in fastening the terminal shield 10 to the circuit breaker 12, for example with a press fit.

FIG. 2D is a side cross sectional view along the section line 2D-2D' of FIG. 2C, showing the current transformer sensor 20 mounted on inside surface 56 of the bottom portion 23 of the terminal shield 10. The load wire 30 is shown inserted through the aperture 30 of the terminal shield 10 and through the hole 22 in the toroidally shaped current transformer sensor 20, in accordance with an example embodiment of the invention.

The terminal shield 10 may be composed of an electrically insulating material whose magnetic properties have a minimal effect on the magnetic field coupling the current transformer sensor 20 and the load wire 25 when carrying a load current 60. For example, the terminal shield 10 may be composed of a thermoplastic, a thermoset plastic, glass, ceramic, rubber, a rubber-derivative, wood, or a wood-derivative material.

Figure 3B:
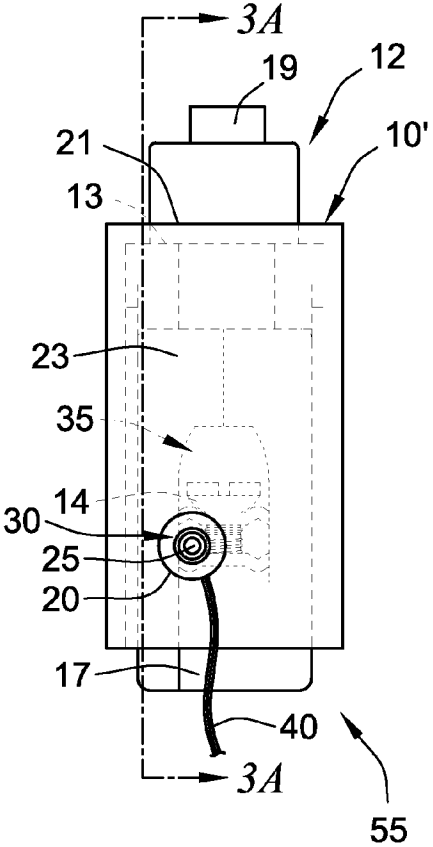
FIG. 3B is a bottom view of the circuit breaker and terminal shield of FIG. 3A in the closed position, showing the toroidally shaped current transformer sensor mounted on the outside of the bottom portion of the terminal shield.
Figure 3A:
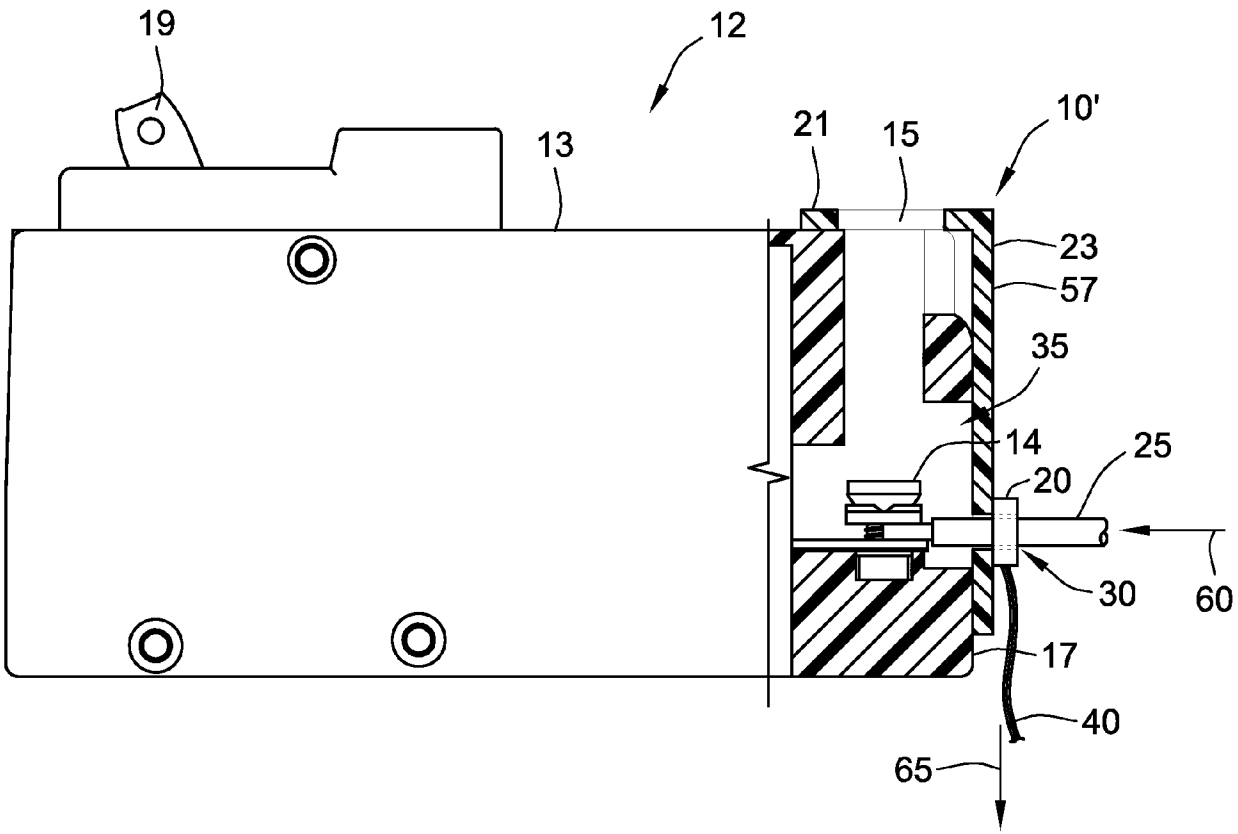
FIG. 3A is a side cross sectional view of another example embodiment of the invention, along the section line 3A-3A' of FIG. 3B, showing the body of the circuit breaker and the terminal shield of FIG. 3, in cross section, with the terminal shield in the closed position. The toroidally shaped current transformer sensor is shown mounted on the outside of the bottom portion of the terminal shield. The load wire is shown inserted through the aperture of the terminal shield and through the hole in the toroidally shaped current transformer sensor, and into electrical contact with the load terminal, in accordance with an example embodiment of the invention.

FIG. 3A is a side cross sectional view of another example embodiment of the invention, along the section line 3A-3A' of FIG. 3B, showing the body of the circuit breaker 12 and the terminal shield 10', shown in cross section, with the terminal shield 10' in the closed position. The toroidally shaped current transformer sensor 20 is shown mounted on the outside surface 57 of the bottom portion 23 of the terminal shield 10'. The load wire 25 is shown inserted through the aperture 30 of the terminal shield and through the hole in the toroidally shaped current transformer sensor 20, and into electrical contact with the load terminal 14, in accordance with an example embodiment of the invention. The mounting of the toroidal transformer 20 to the terminal shield 10' may be by means of an adhesive fastening the toroidal transformer 20 to the outside surface 57 of the terminal shield 10'. Sensor wires 40 from the current transformer sensor 20, may pass along the outside surface 57 of the terminal shield 10', to conduct sensing signal 65 to a measurement device, other equipment, or a network, such as a smart grid network. This arrangement may facilitate access by the operator to the sensor wires 40.

FIG. 3B is a bottom view of the circuit breaker 12 and terminal shield 10' of FIG. 3A, in the closed position, showing the toroidally shaped current transformer sensor 20 mounted on the outside of the bottom portion 23 of the terminal shield 10'.

In still another example embodiment of the invention, the terminal shield 10 may have the current transformer sensor 20 encapsulated within the bottom portion 23 of the terminal shield 10, in accordance with an example embodiment of the invention. The toroidal transformer 20 may be integrally molded into the body of the terminal shield 10, for example, by using a thermoplastic injection molding encapsulation process. The body of the terminal shield 10 may be thicker between the inner surface 56 and the outer surface 57 of the bottom portion 23 so as to envelop the toroidal transformer 20. The load wire 25 may be inserted through the aperture 30 of the terminal shield 10 and through the hole 22 in the toroidally shaped current transformer sensor 20, and into electrical contact with the load terminal 14, in accordance with an example embodiment of the invention.

Although the example embodiment of the invention disclosed is applied to a single pole circuit beaker, the principle of a terminal shield with an integrated current transformer sensor may be applied to multiple pole circuit breakers. For a two-pole circuit breaker, for example, two current transformers are used, one for each load wire. Correspondingly, for a three-pole circuit breaker, three current transformers are used, one for each load wire.

Although specific example embodiments of the invention have been disclosed, persons of skill in the art will appreciate that changes may be made to the details described for the specific example embodiments, without departing from the spirit and the scope of the invention.

What is claimed is:

1. A terminal shield for a circuit breaker, comprising:

a shield structure enclosing a cavity where a load terminal is located within a circuit breaker, the shield structure including an aperture in a bottom portion through which a load wire can be inserted; and a current transformer sensor, mounted on the bottom portion of the shield structure, the current transformer sensor having a hole aligned with the aperture in the shield structure and aligned with the load terminal within the circuit breaker when the shield structure is in a closed position, to enable the load wire to be inserted through the aperture of the shield structure and through the hole of the current transformer sensor and into the load terminal, to enable sensing the load current in the load wire.

2. The terminal shield for a circuit breaker of claim 1, wherein the current transformer sensor is mounted on an inside surface of the bottom portion of the shield structure, and fits within the cavity where the load terminal is located when the shield structure is in the closed position on the circuit breaker.

3. The terminal shield for a circuit breaker of claim 1, wherein the current transformer sensor is mounted on an outside surface of the bottom portion of the shield structure.

4. The terminal shield for a circuit breaker of claim 1, wherein the current transformer sensor is encapsulated within the bottom portion of the shield structure.

5. The terminal shield for a circuit breaker of claim 1, further comprising:

an access hole in a front portion of the shield structure, to enable a tool to access the load terminal when the shield structure is in the closed position, to tighten an electrical connection of the load terminal to the load wire.

6. The terminal shield for a circuit breaker of claim 1, wherein the shield structure protects an operator from touching the load terminal that would otherwise be exposed on the circuit breaker.

7. The terminal shield for a circuit breaker of claim 1, wherein the shield structure is composed of an electrically insulating material drawn from the group consisting of a thermoplastic, a thermoset plastic, glass, ceramic, rubber, a rubber-derivative, wood, and a wood-derivative material.

8. The terminal shield for a circuit breaker of claim 1, wherein the shield structure is formed of an electrically insulating material, having a front portion that fits on a front face of the circuit breaker and the bottom portion that fits on a bottom side of the circuit breaker when the shield structure is in a closed position on the circuit breaker.

9. The terminal shield for a circuit breaker of claim 1, wherein the current transformer sensor is toroidally shaped.

10. The terminal shield for a circuit breaker of claim 1, further comprising:

a sensor wire connected to the current transformer sensor, to conduct a sensing signal in response to sensing the load current with the current transformer sensor.

11. The terminal shield for a circuit breaker of claim 10, wherein the sensing signal is conducted by the sensor wire to a measurement device, other equipment, or a smart grid network.

* * * * *